US007232349B1

(12) United States Patent
Chen

(10) Patent No.: US 7,232,349 B1
(45) Date of Patent: Jun. 19, 2007

(54) RECEPTACLE

(76) Inventor: Chi-Wen Chen, No. 105, Alley 27, Lane 143, Chun-Kung Rd., Taipei City (TW)

( * ) Notice: Subject to any disclaimer, the term of this patent is extended or adjusted under 35 U.S.C. 154(b) by 0 days.

(21) Appl. No.: 11/445,863

(22) Filed: Jun. 2, 2006

(51) Int. Cl.
*H01R 4/36* (2006.01)

(52) U.S. Cl. ..... 439/810

(58) Field of Classification Search ..... 439/810, 439/475; 411/176, 973, 169
See application file for complete search history.

(56) References Cited

U.S. PATENT DOCUMENTS 4,530,556 A * 7/1985 Bonus ..... 439/296
4,627,681 A * 12/1986 Hong ..... 439/370
5,791,931 A * 8/1998 Burkhart, Sr. ..... 439/346
5,893,772 A * 4/1999 Carmo et al. ..... 439/346
6,193,539 B1 * 2/2001 Chang ..... 439/346
7,083,458 B1 * 8/2006 Chang ..... 439/346

* cited by examiner

*Primary Examiner*—Tulsidas C. Patel
*Assistant Examiner*—Phuongchi Nguyen
(74) *Attorney, Agent, or Firm*—Ladas and Parry LLP

(57) ABSTRACT

A receptacle includes: a receptacle housing defining a pair of prong-inserting slots for extension of a pair of prongs of a plug therethrough and into the receptacle housing; a pair of conductive terminals mounted in the receptacle housing and adapted to be connected to the prongs of the plug; and a lock unit including a latch mounted movably in the receptacle housing and operable to move between a locked position, in which the latch is adapted to engage one of the prongs of the plug, thereby preventing undesired removal of the plug from the receptacle housing, and an unlocked position, in which the latch is adapted to disengage the plug, thereby permitting removal of the plug from the receptacle housing.

5 Claims, 8 Drawing Sheets

RECEPTACLE

BACKGROUND OF THE INVENTION

1. Field of the Invention

The invention relates to a receptacle, more particularly to a receptacle that has a lock unit operable to lock releasably prongs of a plug plugged into the receptacle.

2. Description of the Related Art

A conventional receptacle usually includes a receptacle housing defining a pair of prong-inserting slots for extension of a pair of prongs of a plug therethrough and into the receptacle housing, and a pair of conductive terminals mounted in the receptacle housing and adapted to abut against the prongs of the plug plugged into the receptacle. While the prongs of the plug are fitted into the receptacle, there is still a tendency for the prongs to be undesirably and accidentally removed from the receptacle, particularly in the case where the prongs are loosely fitted into the receptacle.

SUMMARY OF THE INVENTION

Therefore, the object of the present invention is to provide a receptacle that can overcome the aforesaid drawback associated with the prior art.

Accordingly, a receptacle of this invention comprises: a receptacle housing defining a pair of prong-inserting slots for extension of a pair of prongs of a plug therethrough and into the receptacle housing; a pair of conductive terminals mounted in the receptacle housing and adapted to be connected to the prongs of the plug; and a lock unit including a latch mounted movably in the receptacle housing and operable to move between a locked position, in which the latch is adapted to engage one of the prongs of the plug, thereby preventing undesired removal of the plug from the receptacle housing, and an unlocked position, in which the latch is adapted to disengage said one of the prongs of the plug, thereby permitting removal of the plug from the receptacle housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
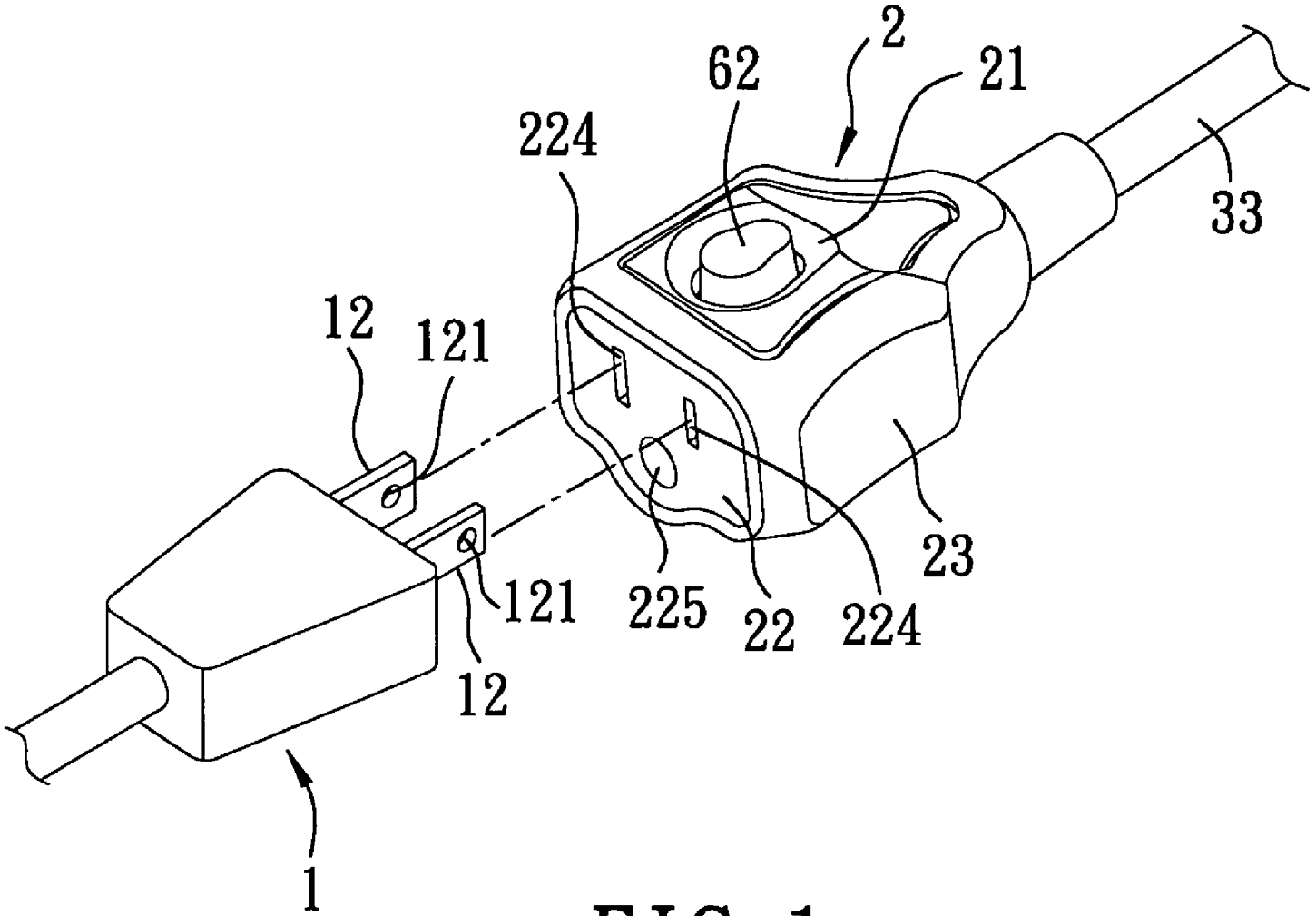
FIG. 1 is a perspective view of the preferred embodiment of a receptacle according to the present invention for connecting with an electric plug.
Figure 2:
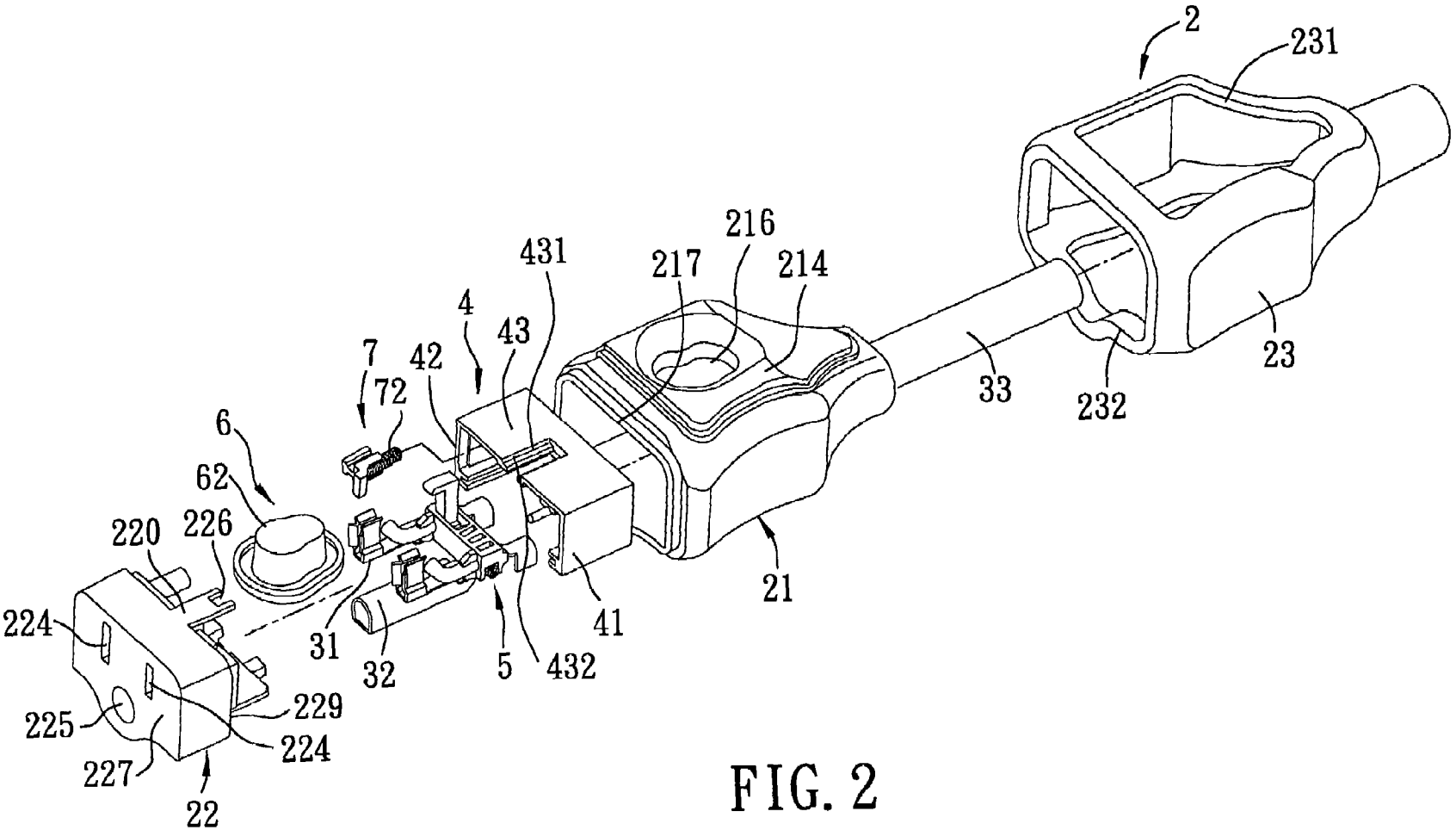
FIG. 2 is an exploded perspective view of the preferred embodiment.
Figure 3:
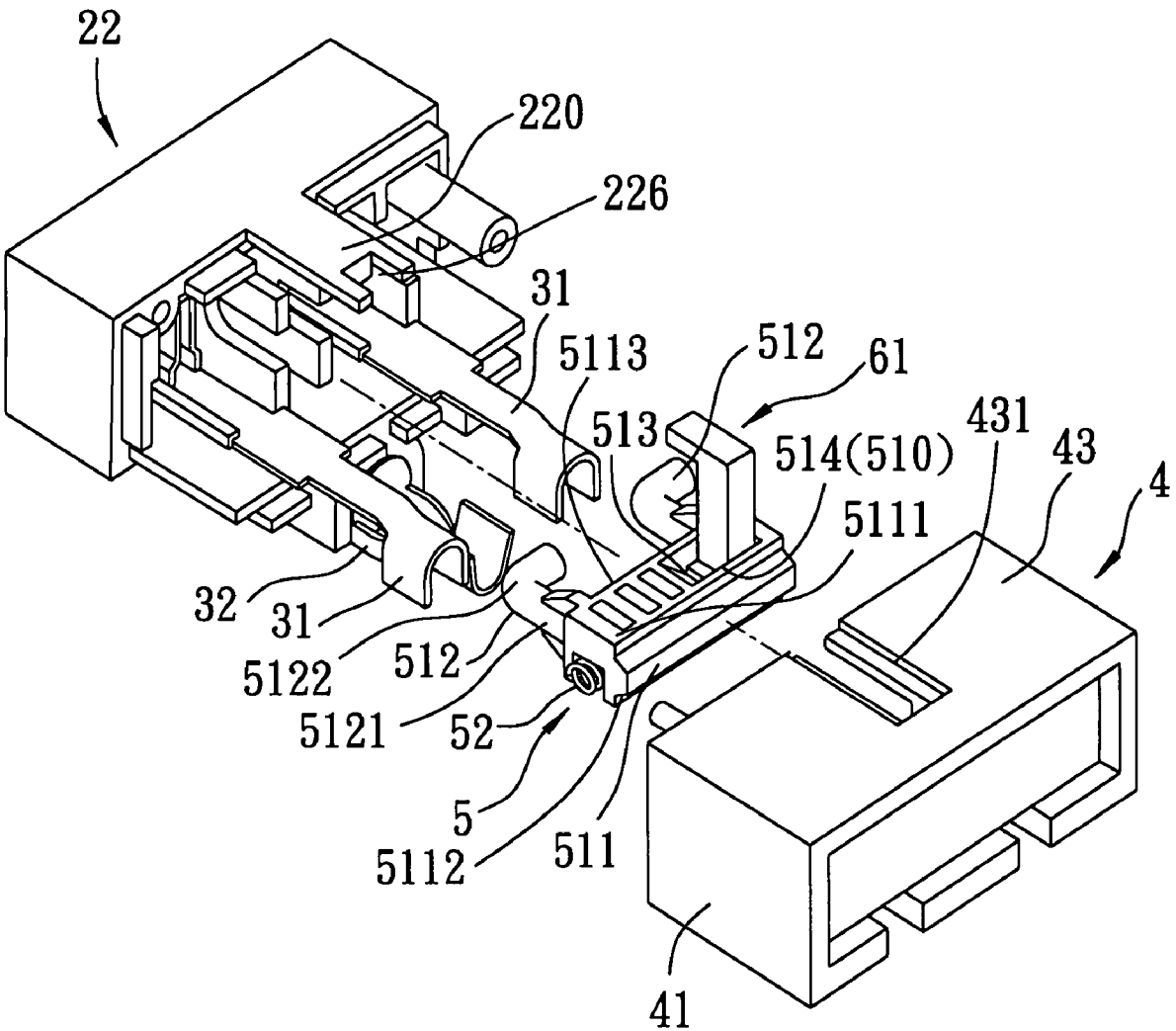
FIG. 3 is an exploded perspective view illustrating a lock unit of the preferred embodiment.

Referring to FIGS. 1, 2, and 3, the preferred embodiment of a receptacle according to the present invention is shown to include: a receptacle housing 2 defining a pair of prong-inserting slots 224 for extension of a pair of prongs 12 of a plug 1 therethrough and into the receptacle housing 2; a pair of conductive terminals 31 mounted in the receptacle housing 2 and adapted to be connected to the prongs 12 of the plug 1; and a lock unit 5 including a pair of latches 512 mounted movably in the receptacle housing 2 and operable to move between a locked position (see FIGS. 4 and 8), in which the latches 512 engage respectively the prongs 12 of the plug 1, thereby preventing undesired removal of the plug 1 from the receptacle housing 2, and an unlocked position (see FIG. 6), in which the latches 512 disengage the prongs 12 of the plug 1, thereby permitting removal of the plug 1 from the receptacle housing 2.

In this embodiment, the receptacle housing 2 also defines a ground-prong hole 225 which is aligned with a ground terminal 32, such that, in the case where the plug 1 is provided with a ground prong (not shown), the ground prong is to be extended into the ground-prong hole 225 when the plug 1 is plugged into the receptacle housing 2.

The lock unit 5 further includes a latch seat 511 having top and bottom ends 5111, 5112 and a lateral side 5113 extending between the top and bottom ends 5111, 5112. The latches 512 extend laterally from the lateral side 5113 of the latch seat 511 so as to be co-movable with the latch seat 511 between the locked and unlocked positions. The lock unit 5 further includes an urging member 52 that urges the latch seat 511 so as to restore the latches 512 and the latch seat 511 from the unlocked position to the locked position. The top end 5111 of the latch seat 511 is formed with a recess 514 defined by a recess-defining wall 510. The recess-defining wall 510 has a slanted wall portion 513.

Figure 5:
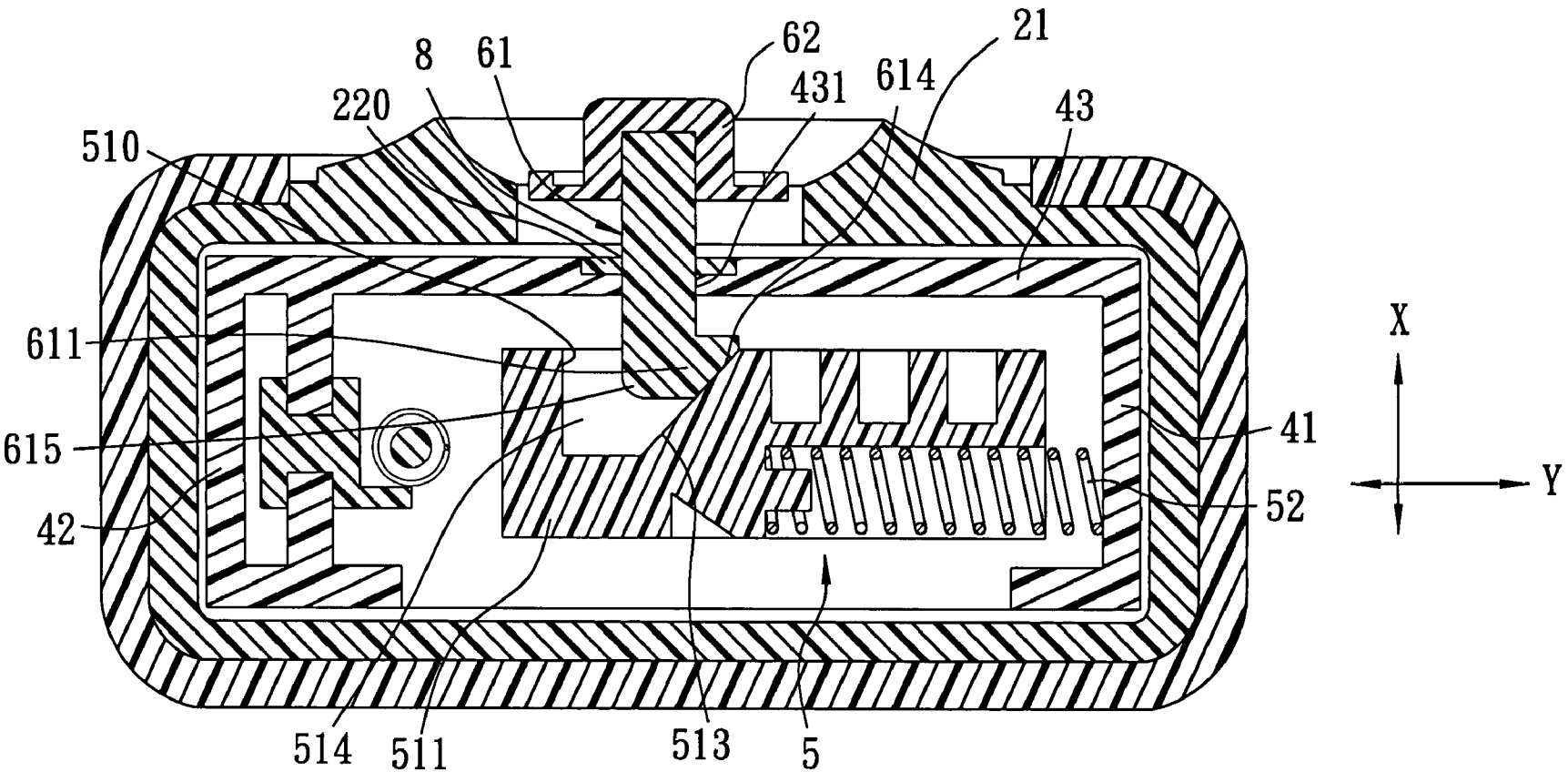
FIG. 5 is a sectional side view to illustrate the state where the latch of the preferred embodiment is disposed at the locked position.
Figure 7:
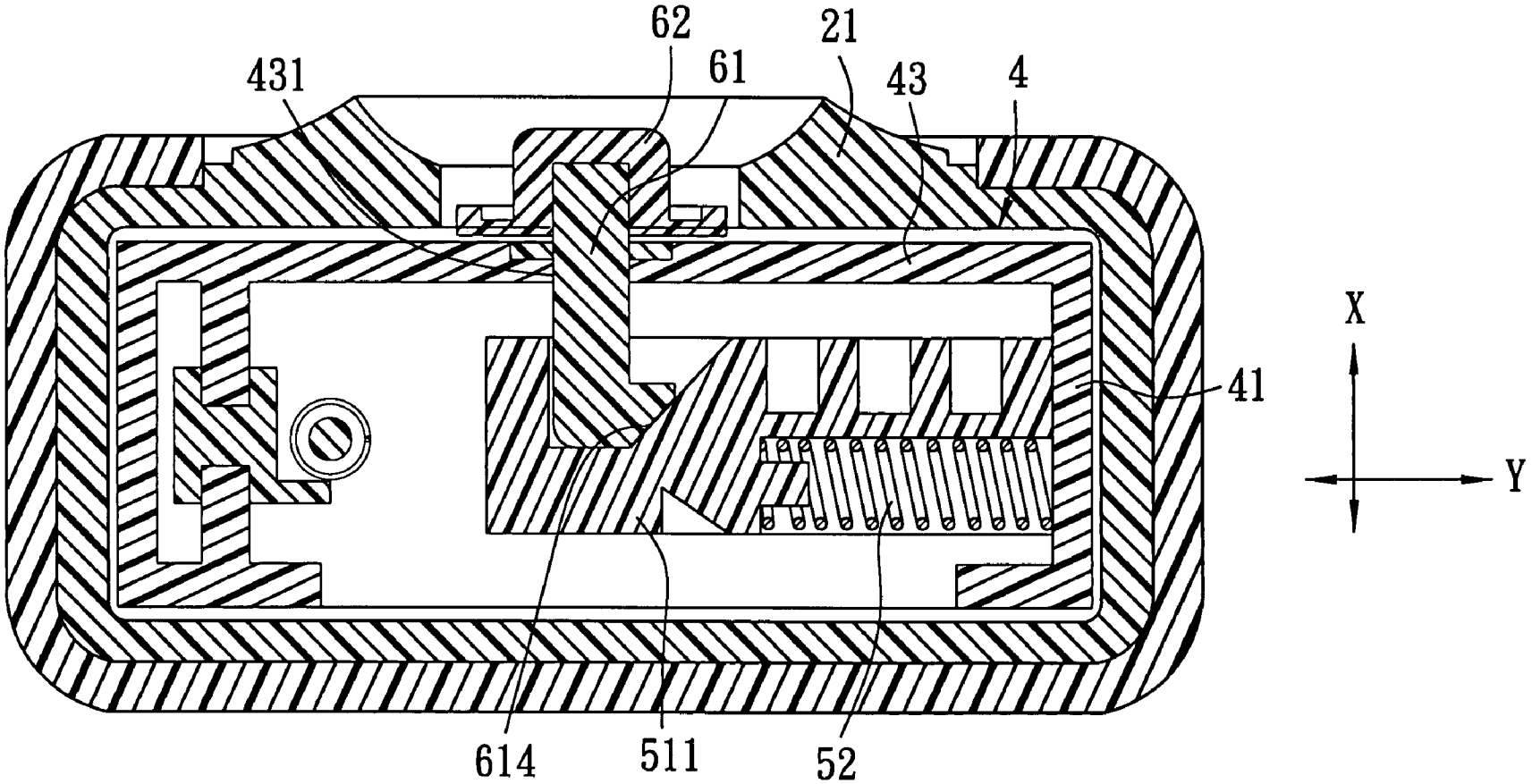
FIG. 7 is a sectional side view to illustrate the state where the latch of the preferred embodiment is disposed at the unlocked position.

The receptacle further includes an operating unit 6 that includes an operating lever 61 mounted movably on the receptacle housing 2, having a lower end 615 extending into the recess 514 in the latch seat 511, and movable between pressed and non-pressed positions (see FIGS. 7 and 5). A press knob 62 is provided on the operating lever 61. The lower end 615 of the operating lever 61 is L-shaped, and has a slanted end face 614 that is in sliding contact with the slanted wall portion 513 of the recess-defining wall 510 of the latch seat 511 so as to move the latches 512 together with the latch seat 511 against urging action of the urging member 52 from the locked position to the unlocked position when the operating lever 61 is moved from the non-pressed position to the pressed position.

Figure 4:
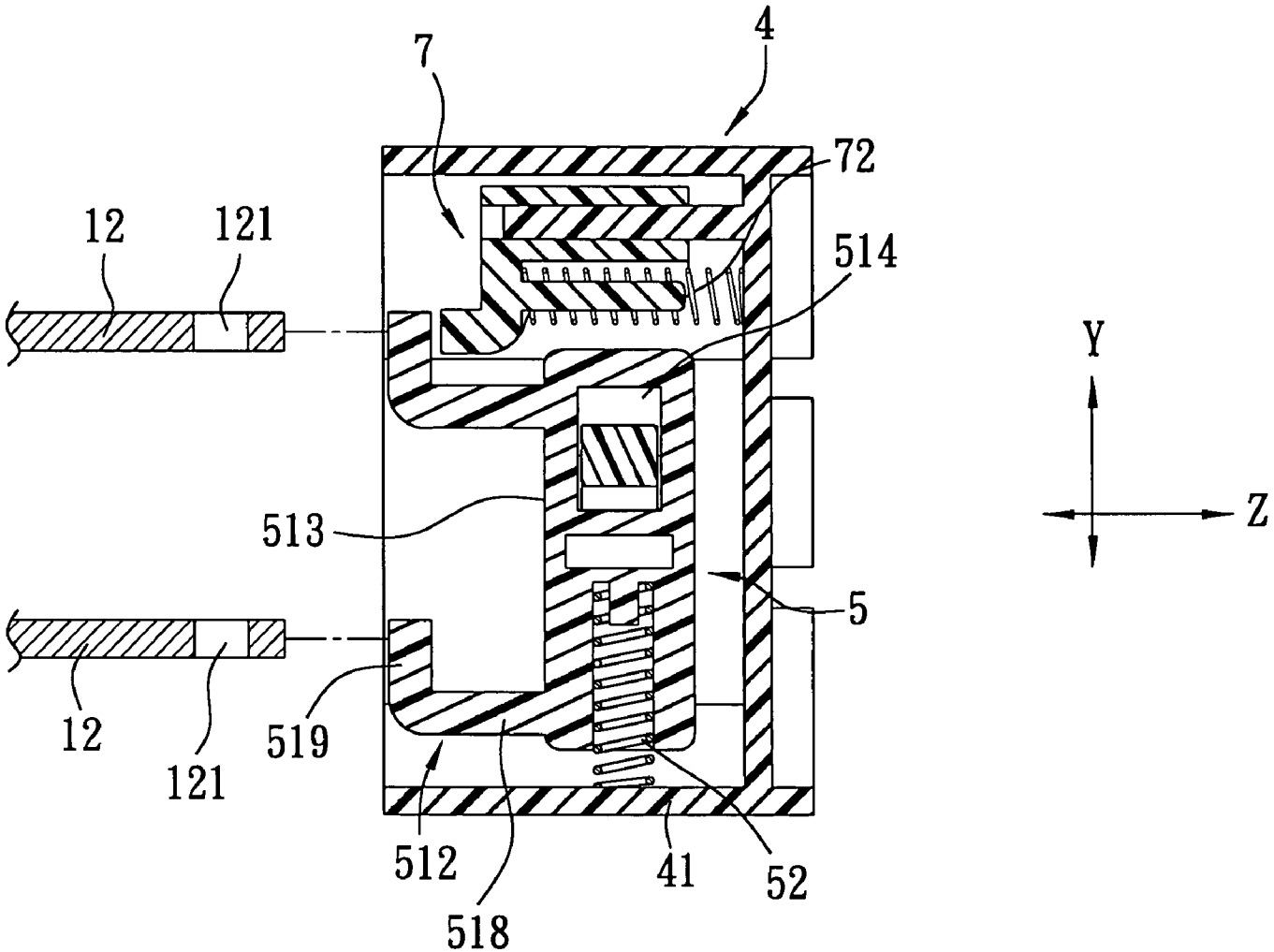
FIG. 4 is a sectional top view to illustrate a state where a latch of the preferred embodiment is disposed at a locked position.

In use, the operating lever 61 is movable between the pressed and non-pressed positions in a first direction (X) (as shown in FIG. 5), and the latch seat 511 is movable between the locked and unlocked positions in a second direction (Y) transverse to the first direction (X). As shown in FIG. 4, each of the latches 512 is in the form of an L-shaped rod that has a first segment 518 extending from the lateral side 5113 of the latch seat 511 in a third direction (Z) transverse to the first and second directions (X, Y), and a second segment 519 extending from the first segment 518 in the second direction (Y) and adapted to engage a prong hole 121 in the respective one of the prongs 12 of the plug 1.

The receptacle housing 2 includes a first housing part 21 that has a front open end 217, and a top wall 214 formed with a through-hole 216, and a second housing part 22 that has a front wall 227 formed with the prong-inserting slots 224, a rear end 229 connected to the front open end 217 of the first housing part 21, and a limiting protrusion 220 extending rearwardly from the rear end 229 of the second housing part 22 into the first housing part 21.

The receptacle further includes a confining frame 4 that is mounted in the first housing part 21, and that has a front open end 42 and a top wall 43 formed with a limiting notch 431 extending from the front open end 42 of the confining frame 41 and defined by a notch-defining wall 432. The limiting protrusion 220 has a U-shaped free end 226 extending into the limiting notch 431 and cooperates with the notch-defining wall 432 to define a limiting hole 8 (see FIG. 5) that is aligned with the through-hole 216 in the top wall 214 of the first housing part 21. The operating lever 61 extends fittingly through the limiting hole 8 so as to avoid wobbling during movement in the first direction (X).

The receptacle further includes a spring-biased returning member 7 that is mounted movably in the receptacle housing 2, that is biased by a compression spring 72, that is adapted to be pushed by one of the prongs 12 of the plug 1 when the plug 1 is plugged into the receptacle housing 2, and that is adapted to bias the plug 1 out of the receptacle housing 2 when the latches 512 are moved to the unlocked position upon movement of the operating lever 61 to the pressed position.

In this embodiment, the receptacle further includes a protective sleeve 23 that is sleeved on the first housing part 21, and that is formed with an upper hole 231 aligned with the through-hole 216 in the first housing part 21, and a front opening 232 for mounting the first housing part 21 in the protective sleeve 23, and a wire line 33 connected electrically to the conductive terminals 31 and the grounding terminal 32, and extending out of the protective sleeve 23.

After assembly, as shown in FIG. 4, by virtue of the urging force of the urging member 52, the latches 512 are moved to the locked position such that the second segments 519 of the latches 512 block rear sides of the prong-inserting slots 224, and such that the prongs 12 of the plug 1 cannot be plugged into the receptacle housing 2.

Figure 6:
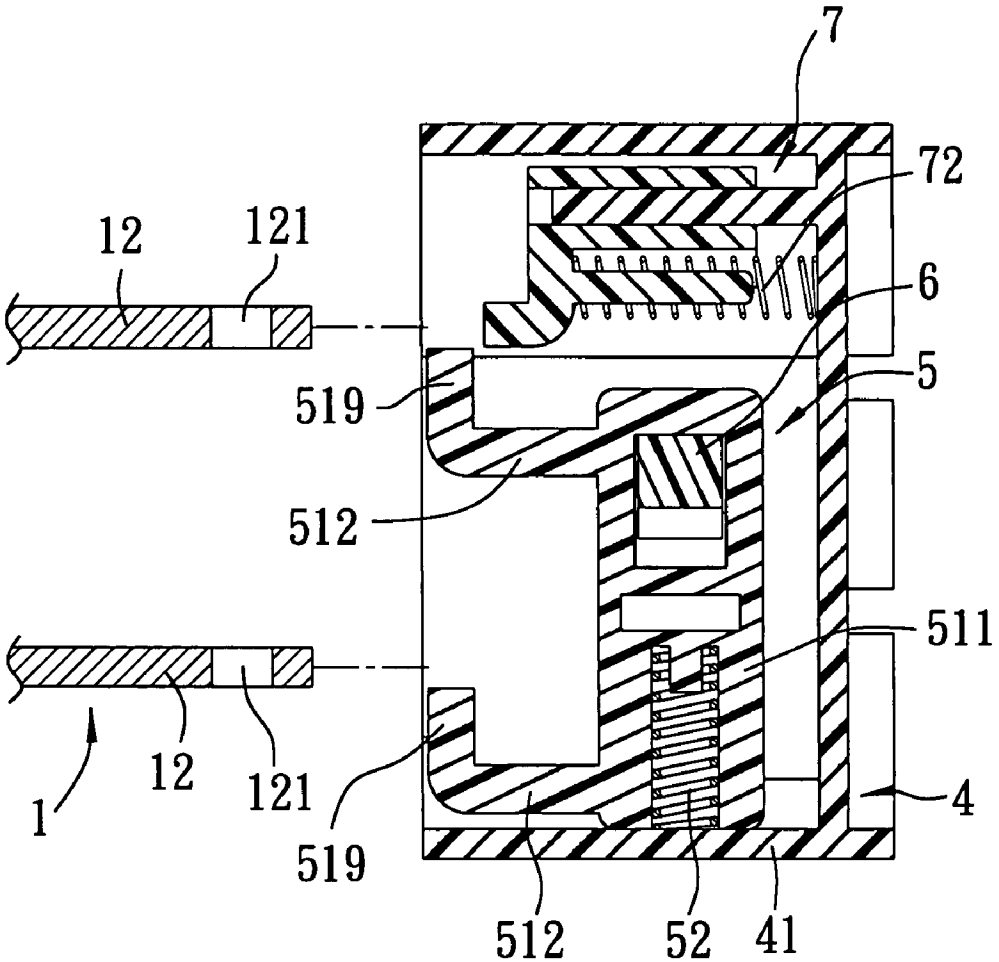
FIG. 6 is a sectional top view to illustrate another state where the latch of the preferred embodiment is disposed at an unlocked position.

Referring to FIGS. 6 and 7, to plug the plug 1 into the receptacle housing 2, the press knob 62 is pressed to move the operating lever 61 downwardly in the first direction (X) such that the slanted end face 614 of the lower end 615 of the operating lever 61 pushes the latch seat 511 against the urging force of the urging member 52 to move from the locked position to the unlocked position along the second direction (Y), and such that the second segments 519 of the latches 512 cease to block the prong-inserting slots 224, thereby permitting insertion of the prongs 12 of the plug 1 into the receptacle housing 2 to contact the conductive terminals 32.

Figure 8:
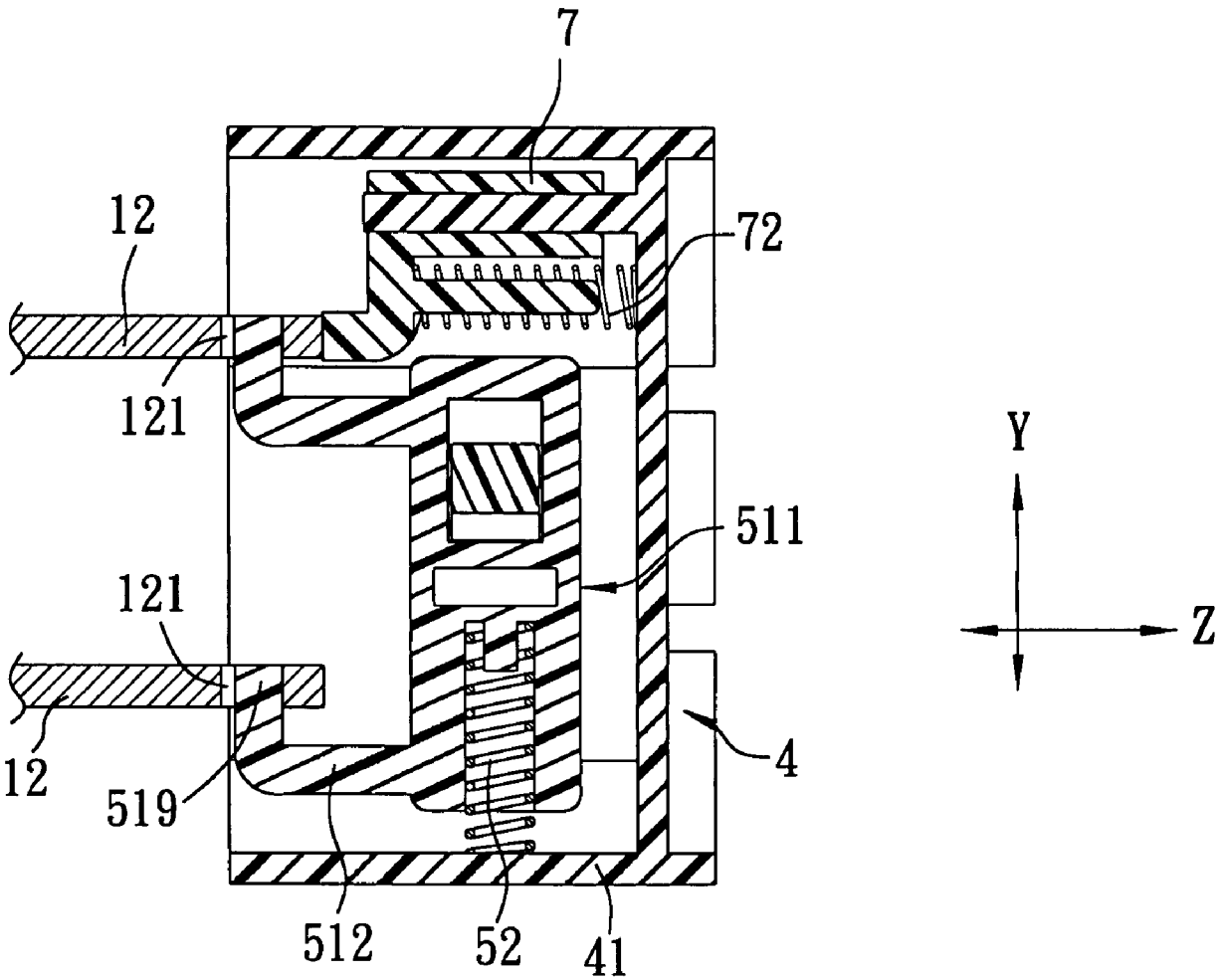
FIG. 8 is a sectional top view to illustrate yet another state where the latch of the preferred embodiment is disposed at the locked position with a plug locked by the latch.

Referring to FIG. 8, in combination with FIG. 2, since the returning member 7 is aligned with one of the prong-inserting slots 224, after extension of the prongs 12 of the plug 1 into the receptacle housing 2, the returning member 7 is pushed by the aligned prong 12 of the plug 1 to move away from the prong-inserting slots 224 in the third direction (Z) against the urging force of the compression spring 72 so as to accumulate a restoring force. When the press knob 62 is released, the urging member 52 urges the latch seat 511 to the locked position such that the second segments 519 of the latches 512 engage the prong holes 121 of the prongs 12 of the plug 1, respectively.

To remove the plug 1 from the receptacle housing 2, the press knob 62 is pressed to move the operating lever 61 downwardly in the first direction (X) to the pressed position and the latch seat 511 to the unlocked position against the urging force of the urging member 52. At this time, there turning member 7 urged by the compressing spring 72 pushes the prongs 21 of the plug 1 to move out of the receptacle housing 2.

With the inclusion of the lock unit 5 in the receptacle of this invention, the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A receptacle comprising:

a receptacle housing defining a pair of prong-inserting slots for extension of a pair of prongs of a plug therethrough and into said receptacle housing;

a pair of conductive terminals mounted in said receptacle housing and adapted to be connected to the prongs of the plug; and a lock unit including a latch mounted movably in said receptacle housing and operable to move between a locked position, in which said latch is adapted to engage one of the prongs of the plug, thereby preventing undesired removal of the plug from said receptacle housing, and an unlocked position, in which said latch is adapted to disengage said one of the prongs of the plug, thereby permitting removal of the plug from said receptacle housing, wherein said lock unit further includes a latch seat having top and bottom ends and a lateral side extending between said top and bottom ends, said latch extending from said lateral side of said latch seat so as to be co-movable with said latch seat between said locked and unlocked positions, said lock unit further including an urging member for restoring said latch and said latch seat from said unlocked position to said locked position, said top end of said latch seat being formed with a recess defined by a recess-defining wall, said recess-defining wall having a slanted wall portion, said receptacle further comprising an operating unit that includes an operating lever mounted movably on said receptacle housing, having a lower end extending into said recess in said latch seat, and movable between pressed and non-pressed positions, said lower end of said operating lever having a slanted end face that is in sliding contact with said slanted wall portion of said recess-defining wall of said latch seat so as to move said latch together with said latch seat against urging action of said urging member from said locked position to said unlocked position when said operating lever is moved from said non-pressed position to said pressed position.

2. The receptacle as claimed in claim 1, wherein said lower end of said operating lever is L-shaped.

3. The receptacle as claimed in claim 1, further comprising a spring-biased returning member that is mounted movably in said receptacle housing, that is adapted to be pushed by one of the prongs of the plug when the prongs are inserted into said receptacle housing, and that is adapted to bias the plug out of said receptacle housing when said latch is moved to said unlocked position upon movement of said operating lever to said pressed position.

4. The receptacle as claimed in claim 1, wherein said operating lever is movable between said pressed and non-pressed positions in a first direction, said latch seat being movable between said locked and unlocked positions in a second direction transverse to said first direction, said latch being in the form of an L-shaped rod that has a first segment extending from said lateral side of said latch seat in a third direction transverse to said first and second directions, and a second segment extending from said first segment in said second direction and adapted to engage said one of the prongs of the plug.

5. The receptacle as claimed in claim 4, wherein said receptacle housing includes a first housing part that has a front open end and a top wall formed with a through-hole, and a second housing part that has a front wall formed with said prong-inserting slots, a rear end connected to said front open end of said first housing part, and a limiting protrusion extending rearwardly from said rear end of said second housing part into said first housing part, said receptacle further comprising a confining frame that is mounted in said first housing part, and that has a front open end and a top wall formed with a limiting notch extending from said front open end of said confining frame and defined by a notch-defining wall, said limiting protrusion having a U-shaped free end extending into said limiting notch and cooperating with said notch-defining wall to define a limiting hole that is aligned with said through-hole in said top wall of said first housing part, said operating lever extending fittingly through said limiting hole so as to avoid wobbling during movement in said first direction.

* * * * *